US009186880B1

(12) United States Patent
Vasilantone

(10) Patent No.: US 9,186,880 B1
(45) Date of Patent: Nov. 17, 2015

(54) DETACHABLE PRINT SCREEN FABRIC ASSEMBLY FOR USE IN A FRAME TENSIONING SYSTEM

(71) Applicant: Michael M Vasilantone, Lakewood, NJ (US)

(72) Inventor: Michael M Vasilantone, Lakewood, NJ (US)

( * ) Notice: Subject to any disclaimer, the term of this patent is extended or adjusted under 35 U.S.C. 154(b) by 0 days.

(21) Appl. No.: 14/544,104

(22) Filed: Nov. 26, 2014

(51) Int. Cl.
*B41F 15/34* (2006.01)

(52) U.S. Cl.
CPC ..... *B41F 15/34* (2013.01)

(58) Field of Classification Search
CPC ..... B05C 17/06; B41F 15/0813; B41F 15/34; B41F 15/36; D06C 3/08
USPC ..... 101/127.1, 128.1, 114; 38/102.1, 38/102.21, 102.3, 102.4, 102.5, 102.91; 160/378–381
See application file for complete search history.

(56) References Cited

U.S. PATENT DOCUMENTS

| | | | | |
|---|---|---|---|---|
| 3,908,293 | A | 9/1975 | Newman | 38/102.91 |
| 4,409,749 | A * | 10/1983 | Hamu | 38/102.3 |
| 5,957,048 | A * | 9/1999 | Newman, Jr. | 101/127.1 |
| 8,220,387 | B2 * | 7/2012 | Niswonger | 101/127.1 |
| 2008/0184902 | A1 * | 8/2008 | Vasilantone | 101/415.1 |

* cited by examiner

*Primary Examiner* — Leslie J Evanisko
(74) *Attorney, Agent, or Firm* — Clifford G. Frayne

(57) ABSTRACT

A print screen frame tensioning system, generally rectangular in shape and fabricated from extruded tubular rails, each rail of the frame having a longitudinal channel, generally circular in cross sectional area, formed in each of the tubular rails for substantially the length of the tubular rails for receipt of a tension roller, the tension roller having its entire length axially serrated in order to accept a tensioning tool at one end, the tension roller having a longitudinal groove or slot formed therein for receipt of a fabric panel and locking strip, there being a locking strip associated with each edge of a fabric panel being slidably secured to each tension roller.

7 Claims, 6 Drawing Sheets

DETACHABLE PRINT SCREEN FABRIC ASSEMBLY FOR USE IN A FRAME TENSIONING SYSTEM

RELATED APPLICATIONS

This application is a continuation-in-part of application Ser. No. 14/214,358, filed Mar. 14, 2014.

BACKGROUND OF THE INVENTION

1. Field of the Invention

The present invention relates to fabric stretchers and more particularly to an apparatus for tensioning and re-tensioning screen fabric for use in screen printing processing or the like.

2. Description of the Prior Art

Stretching frames are used for a wide variety of applications, including oil painting and the graphic arts. In the graphic arts, screen printing frames are used in the screen printing industry in association with a fabric panel of particular mesh size. The fabric panel as used in the screen print industry is manufactured from polyester and is typically supported and positively attached directly to the frame, then tensioned between opposing sides of the screen printing frame. The term "printing screen" as used in the industry refers to a screen printing frame with fabric panel secured thereto, either stenciled or as yet unstenciled. The mesh, when uniformly stretched in a taut plane, provides the foundation for a stencil. Printing ink is then forced through the open areas of the stencil by means of a blade or squeegee creating an image in the shape of the stencil on the work piece positioned beneath the fabric panel. In order to achieve optimum results, several factors must be considered. The fabric panel must be maintained at the recommended working tension throughout the print run so the pattern is transferred with accuracy. Tension variation must be kept to a minimum. Off contact must be kept to a minimum.

During the printing stroke, the squeegee blade deflects the fabric panel downwardly forcing it into direct contact with the work piece during its passage across the screen. This deflection causes the fabric panel to be stretched from its undisturbed condition. The constant cycle of stretching and snapping back accelerates the deterioration of both the fabric panel and the stencil, especially if the fabric panel is skewed during installation. Proper tensioning decreases off contact, improves image quality and provides longer stencil and image life. Additionally, as the fabric panel undergoes these distorting forces during the print stroke, the stencil in the screen may also be distorted. This can result in a slightly distorted image on the work piece.

Typical tubular alloy screen printing frames used to stretch the fabric panel utilize tensioning devices positioned in most cases on all four sides of the frame. The fabric panel is pulled over these tensioning devices and locked in place without the necessary squaring means. In doing so, the screen printing frame may become slightly distorted and this distortion can cause the off contact distance between the screen and the work piece to vary across the print area with a consequent reduction in print quality.

The essence of re-tensioning is to maintain a specific tension value in newtons. The majority of screen printing frames currently available do not allow the fabric panel and stencil to be easily removed and reinstalled on the frame, nor do they allow for easy retensioning of the fabric panel during operation. Consequently fabric panels, including the stenciled mesh, must remain mounted on their screen printing frames, known as the printing screen, between print runs. Removal of the mesh and accurate reinstallation for later use represents an improvement over the prior art. Applicant's U.S. Pat. No. 6,739,079 and U.S. Pat. No. 7,536,951 addressed some of the aforesaid problems and this application represents a novel improvement to those teachings and the screen printing industry, and in particular, the fabric panel construction.

OBJECTS OF THE INVENTION

An object of the present invention is to provide for a novel print screen printing frame tensioning apparatus which allows for the accurate tensioning of the fabric panel and re-tensioning of the fabric panel during use.

A further object of the present invention is to provide for a novel fabric panel having its corners removed for access, ease and accuracy in tensioning the fabric panel on the frame.

A further object of the present invention is to provide for a novel fabric panel formed with a sleeve along each edge for receipt of a locking strip.

A further object of the present invention is to provide for a novel fabric panel which has its marginal periphery coated with a sealant to prevent ink seepage and to define a central window on the fabric panel for the application of stencil material.

A still further object of the present invention is to provide for a novel fabric panel which has associated with each of the sleeves formed on the edges thereof an excess piece of fabric panel for contact with a tension roller to prevent the abrading of the fabric panel during use and during repeated use.

A still further object of the present invention is to provide for a novel fabric panel, the structure of which allows for the fabric panel to be tensioned during the printing process.

A still further object of the present invention is to provide for a novel fabric panel, the structure of which allows for the ease and facile attachment to the frame and removal from the frame, allowing only the fabric panel to be stored for future use separately without being maintained on the screen printing frame.

A further object of the present invention is to provide for a novel print screen frame tensioning apparatus which is easily assembled and has few moving parts.

A still further object of the present invention is to provide for a novel print screen frame tensioning system which allows for the fabric panel to be stored for reuse without the necessity of maintaining the fabric panel on the frame.

A still further object of the present invention is to provide for a novel mechanical frame and specifically mated fabric panel where the fabric panel can be attached and detached easily.

A still further object of the present invention is to provide for a novel print screen frame that can accept multiple stencils.

A still further object of the present invention is to provide for a mated fabric panel that has embedded fabric locking strips in the edges thereof.

A still further object of the present invention is to provide for a novel fabric panel that can be stored or discarded along with its incorporated locking strips.

A still further object of the present invention is to provide along the four sides of the panel a sealant that eliminates taping the frame against the panel in order to contain the ink.

A still further object of the present invention is to eliminate the multitude of used screen frames that pollute the shop atmosphere and allows the used stencil panels to be stored in vented file cabinets.

SUMMARY OF THE INVENTION

A print screen frame tensioning system, generally rectangular in shape and fabricated from extruded tubular rails, each rail of the frame having a longitudinal channel, generally circular in cross sectional area, formed in each of the tubular rails for substantially the length of the tubular rails for receipt of a tension roller, the tension roller having its entire length axially serrated in order to accept a tensioning tool at one end, the tension roller having a longitudinal groove or slot formed therein for receipt of a fabric panel and locking strip, there being a locking strip associated with each edge of a fabric panel being slidably secured to each tension roller.

BRIEF DESCRIPTION OF THE DRAWINGS

These and other objects of the present invention will become apparent particularly when taken in light of the following illustrations wherein.

DETAILED DESCRIPTION OF THE DRAWINGS

Applicant in describing the invention herein will refer to surfaces as being upper or lower, upper being in the printing mode. In doing so the Applicant is referring to the surfaces in the assembly phase of the screen tensioning system. Those with skill in the art will recognize that in actual usage, the frame as assembled is inverted for the application of the printing ink.

Figure 1:
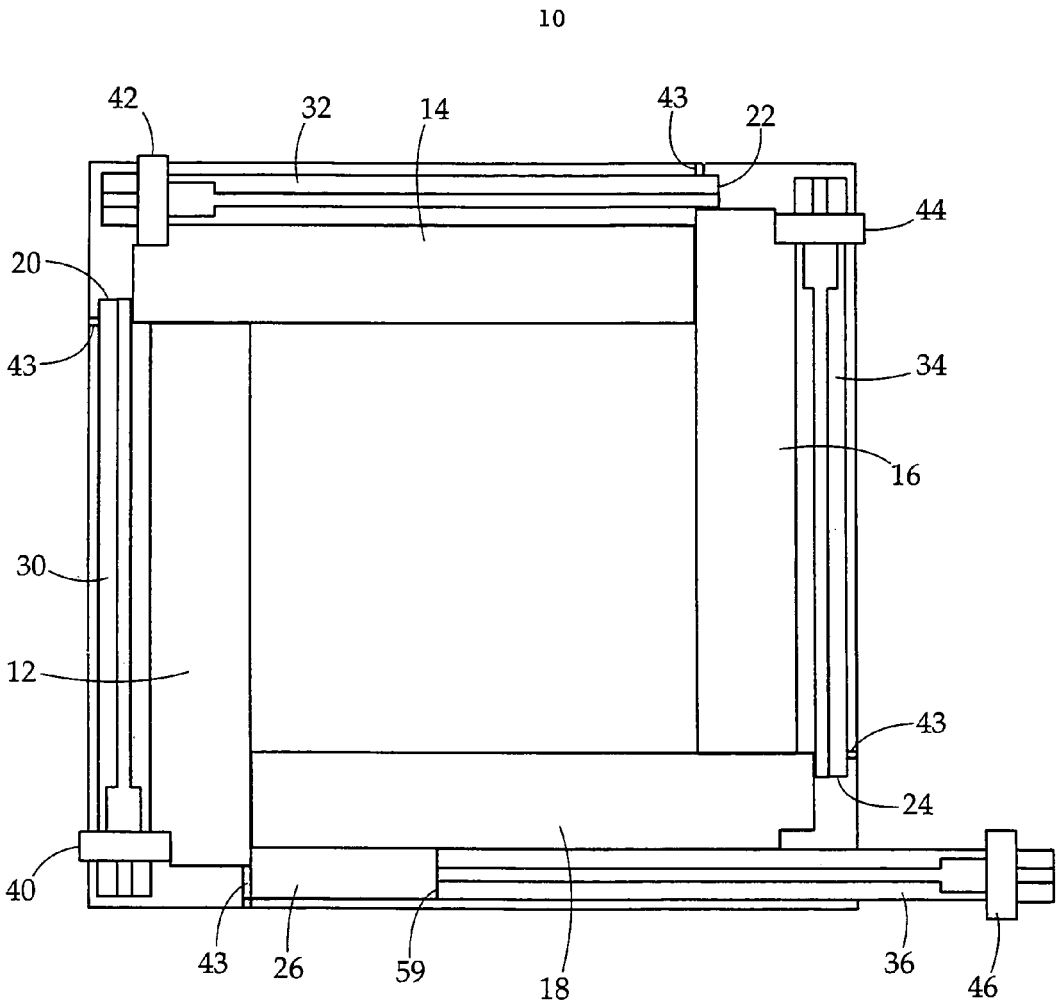
FIG. 1 is a top planar view of a print screen frame 10.

FIG. 1 is a top planar view of a screen printing frame 10. The frame is assembled of four tubular side rails 12, 14, 16, and 18. Each of the side rails is formed with a longitudinal trough of generally circular cross section 20, 22, 24, and 26 for receipt of four tension rollers 30, 32, 34, and 36. Each tubular side rail is formed with a ratchet end in which there is secured a ratchet member 40, 42, 44, and 46. The tension rollers are designed to slide into the troughs from the ratchet ends of the tubular side rails, pass through the ratchet members, and engage the ratchet end of the next adjacent tubular member as discussed hereafter. Each tension roller extends outwardly from the tubular rail a distance for allowing the engagement of a tensioning device such as a wrench or ratchet onto the end of the tension roller in order to apply the tension of a fabric panel as hereinafter described. The tension roller and its respective ratchet member 40, 42, 44, and 46 can be secured together by two retainers in the sides of the ratchet.

Figure 8:
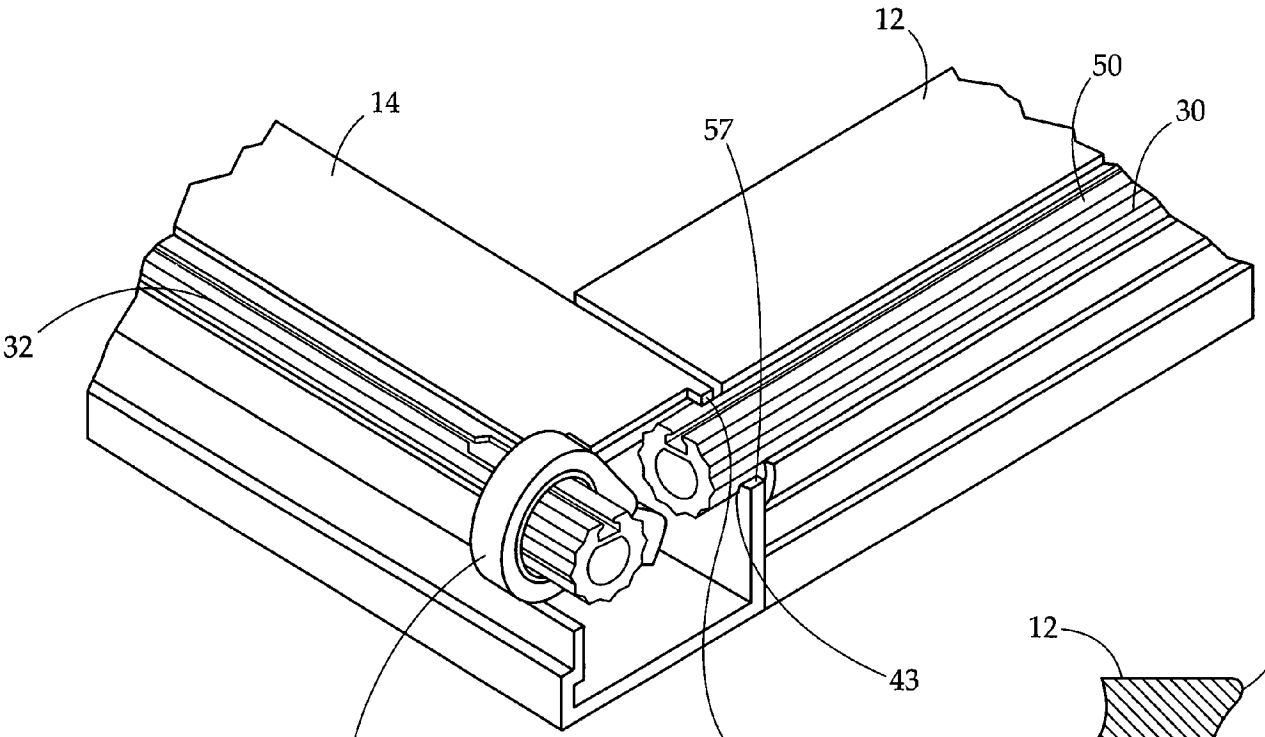
FIG. 8 is an enlarged, perspective, partial cutaway view of the corner of the print screen frame of the present invention.
Figure 9:
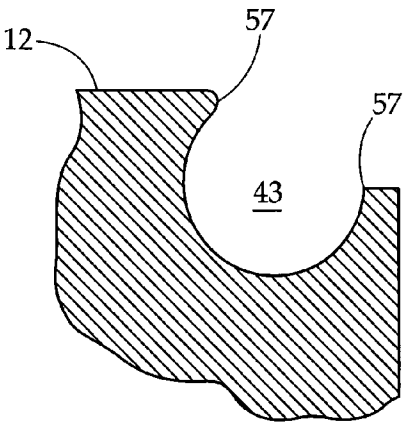
FIG. 9 is an end view of a pocket aperture within which an end of a tension roller sits.

In FIG. 1, three tension rollers are shown in their tensioning position in the frame. Tension roller 36 is illustrated as being inserted into its trough to show how it is slidably inserted into the trough 26 and with its ratchet 46. The disengageability of ratchet 46 and its associated tension roller 36 will be further discussed with respect to the insertion and removal of a fabric panel. FIG. 1 also illustrates that the tension rollers engage a closely fitted pocket aperture 43 in the side wall of the adjacent tubular side rail. FIG. 9 illustrates a close up end view of pocket aperture 43, and FIG. 8 is a close up perspective view of a corner of the frame.

Figure 2:
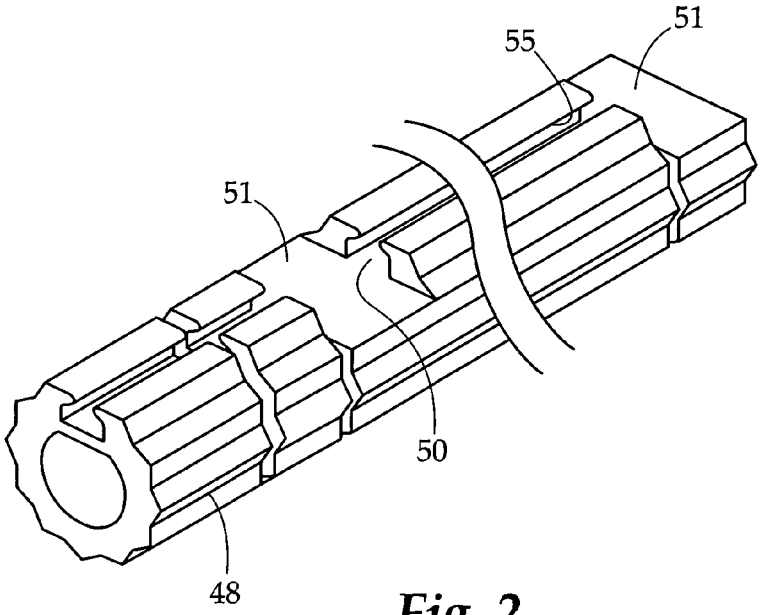
FIG. 2 is a perspective view of a tension roller of the present invention.
Figure 4:
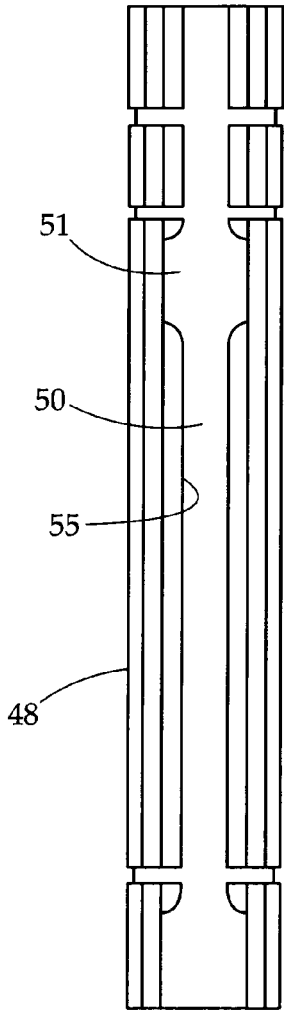
FIG. 4 is a top view of a tension roller of the present invention.
Figure 3:
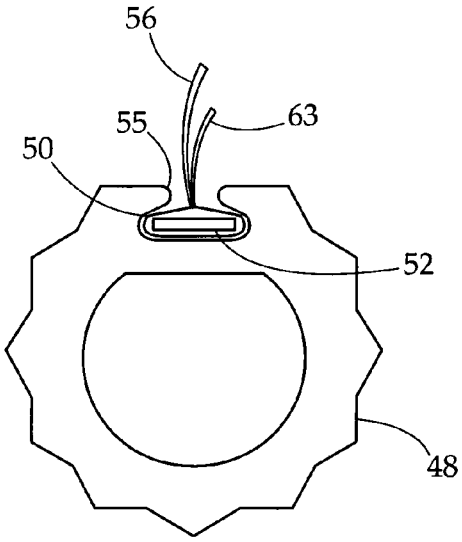
FIG. 3 is an end view of a tension roller of the present invention.

FIGS. 2, 3, and 4 are illustrative of the tension rollers. FIG. 2 illustrates a tension roller generally cylindrical in shape having a slightly fluted outer surface 48. The dimension of the tension roller is such that it fits within its respective trough 20, 22, 24, and 26, and interlocks with the ratchet mechanism allowing it to rotate on its axis and is journalled in the side wall of an adjacent tubular rail.

FIG. 3 illustrates an end view of the tension roller and illustrates that its circumference it is formed with a longitudinal groove or slot 50 on its external circumference for receipt of a locking strip 52 which is slidably positioned in the edge of a fabric panel 56 as more fully described hereafter. The groove or slot 50 allows for the locking strip to be secured onto the circumference of the tension roller in order that it can be tensioned across frame 10. The insertion of the locking strip 52 is aided by a flat or planar portion 51 of the tension roller 30, 32, 34, and 36, immediately adjacent and defining an entryway in the groove or slot 50 for introduction of a locking strip. Groove or slot 50 also is formed with a slit 55 longitudinally along its upper surface to facilitate the slidable insertion of an edge of the fabric panel 56 which is attached to the locking strip 52.

FIG. 4 is a top view of tension roller 36 illustrating again its fluted external circumference, and the groove or slot member 50. An area adjacent the groove or slot member at either one or two locations is the flattened or planar area 51 on the surface of the tension roller. It is in this area that a locking strip of the fabric panel may be introduced into the groove or slot member 50 and slideably extended there through, locking one side of the fabric panel in position on a respective tension roller. The same procedure is followed with respect to each tension roller and the respective locking strip 52 which is associated with each and which is secured to the screen. At least one flattened or planar area 51 is preferred per roller, however, two flattened or planar areas 51 proximate opposing end of the tension rollers provides the user with additional flexibility in introducing a locking strip.

Additionally, another alternative exists with respect to the insertion of the locking strip and fabric panel. The design of the ratchet end of the tubular rail as illustrated in close up view FIG. 8, indicates that the end 59 of the tension roller not associated with the ratchet is positioned in a pocket aperture 43 which is not completely circular in cross sectional area, but contains a gap member 57. The aperture 43 is of sufficient circumference to prevent the tension roller from being pulled upwardly and outwardly from its respective trough, but does not interfere with the groove or slot 50 which extends the longitudinal length of the tension roller. Therefore with the tension roller in position as illustrated in FIG. 8, the locking strip 52 and fabric panel 56 can be directly secured onto the groove or slot 50 because the end 59 of the tension roller provides access to the terminal end of the groove or slot 50. This provides an alternative manner of inserting the locking strip and fabric panel with the tension roller in place. When the fourth edge of the fabric panel 56 with the associated locking strip 52 is to be inserted into the final tension roller, three tension rollers having previously been loaded, there is oftentimes not enough play in the panel to allow its insertion with its respective locking strip into the last tension roller, unless the tension roller is slidably adjusted from aperture 43, thus presenting the terminal end 59 of tension roller and the groove or slot 50 in a more convenient location for the insertion of the locking strip 52 and the fabric panel 56. Once positioned into the fourth tension roller, the terminal end 59 may be reinserted into the aperture 43 securing the tension roller.

Figure 5:
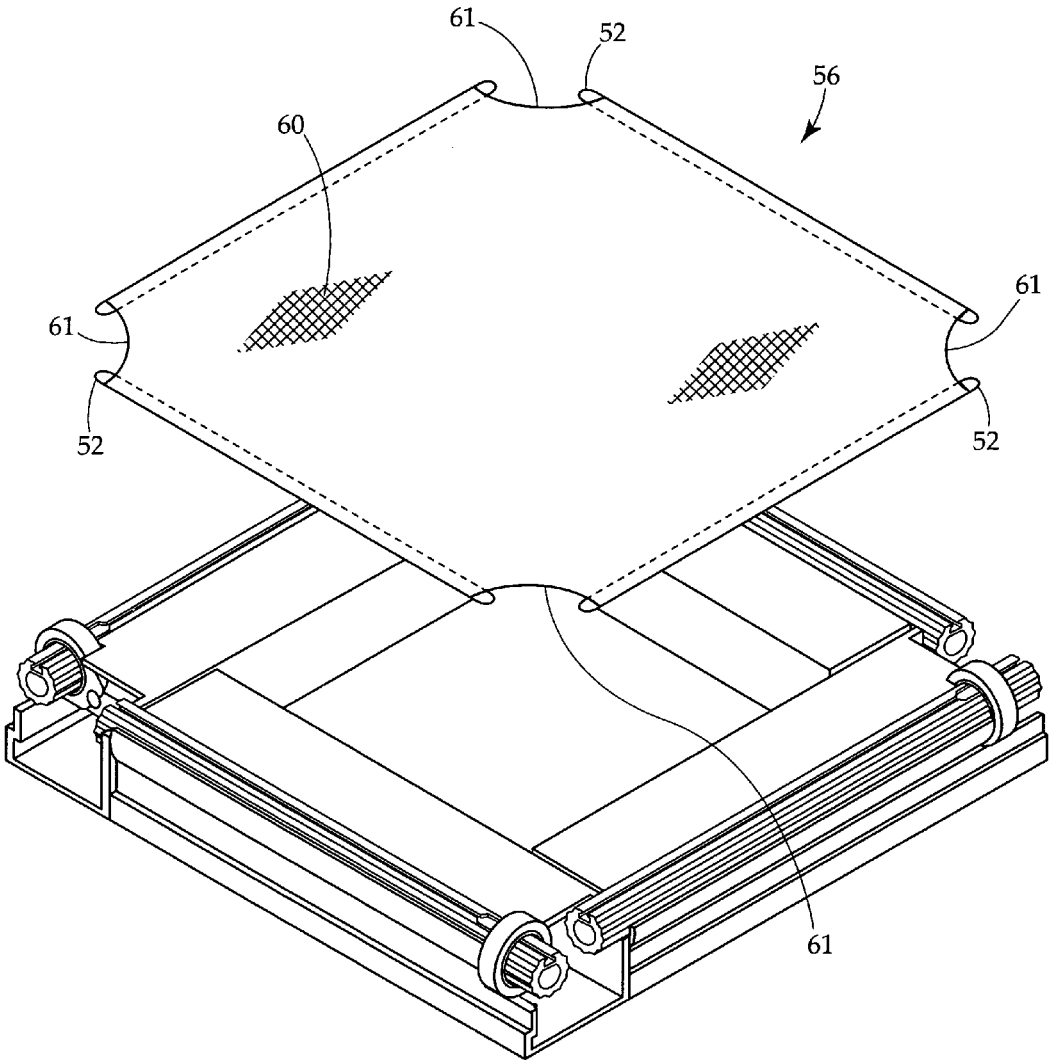
FIG. 5 is a top planar view of the propriety fabric panel utilized with the screen tensioning frame of the present invention.

FIG. 5 is a top planar view of the fabric panel 56. The fabric panel 56 is comprised of the mesh material 60 utilized in the graphic arts. The corners 61 are removed with an arc cut to allow for proper and even tensioning on the frame. Each peripheral straight edge of the fabric panel is formed with a channel or sleeve 62 which allows for a locking strip 52 to be inserted therein and then the locking strip 52 with the enveloping screen mesh sleeve 62 is then slideably positioned in the groove or slot 50 on a tension roller. Each channel or sleeve is preferably formed with an excess of material 63 on the underside or tension roller contact side of the fabric panel to prevent abrasion from repeated use to the fabric panel upon tensioning as illustrated in FIG. 6.

Figure 6:
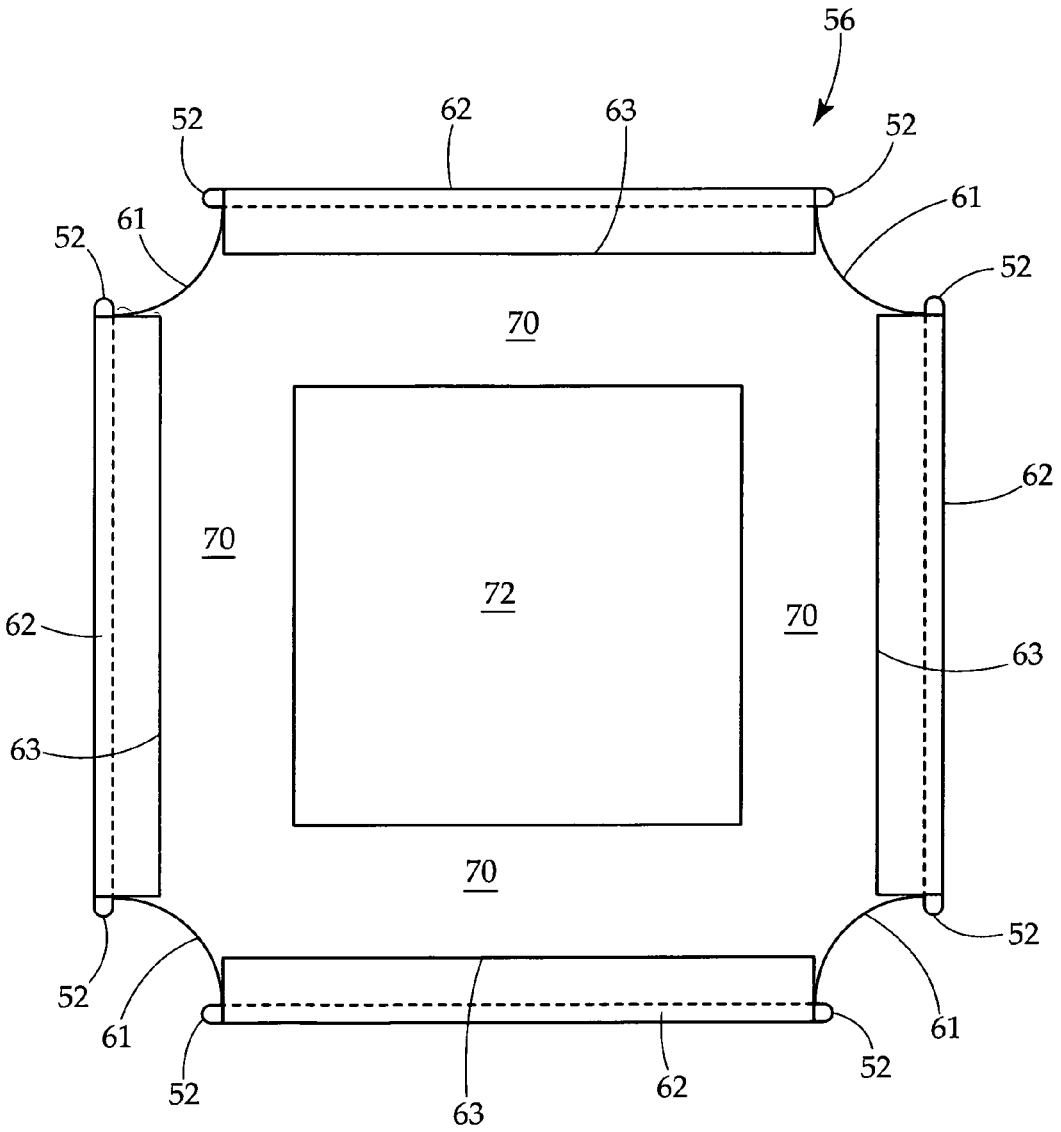
FIG. 6 is a bottom planar view of the proprietary fabric panel utilized with the print screen frame.

FIG. 6 is a bottom planar view of the fabric panel utilized in the present invention. FIG. 6 provides a clear illustration of excess material 63 which is formed after the channel or sleeve 62 is formed along each edge of the fabric panel. This excess material 63 is designed to contact the tension rollers 30, 32, 34, and 36 in order to absorb pressure and to prevent abrasion of the actual fabric panel onto which the actual stencils and ink are applied.

Applicant's fabric panel is precoated on the mesh 60 with a sealant which prevents the ink from penetrating the particular peripheral areas of the mesh 60 and defines the window upon which the printing process and the design will take place. FIG. 6 illustrates these areas 70, which extend inwardly from the edges of the fabric panel 56 and define the area or window 72 on which the stencil and ink will be applied in transfer and maintaining the areas 70 free from ink transfer.

Referring back to FIG. 3 an end view of a tension roller illustrating the manner in which the locking strip and the fabric panel are inserted into the slot or groove on the tension roller. The locking strip 52 is oriented into a substantial horizontal orientation and positioned on one of the flat planar areas 51 on the respective tension roller, or aligned with terminal end 59 of the tension roller and inserted into groove or slot 50. The fabric panel 56 is oriented so that it can be slid edgewise along with the locking strip into the groove or slot 50. The fabric panel 56 is slid simultaneously with the locking strip in an edgewise orientation into the slit member 55 formed longitudinally on the top of groove or slot member 50, while the locking strip 52 inserted into the groove or slot 50.

Figure 7:
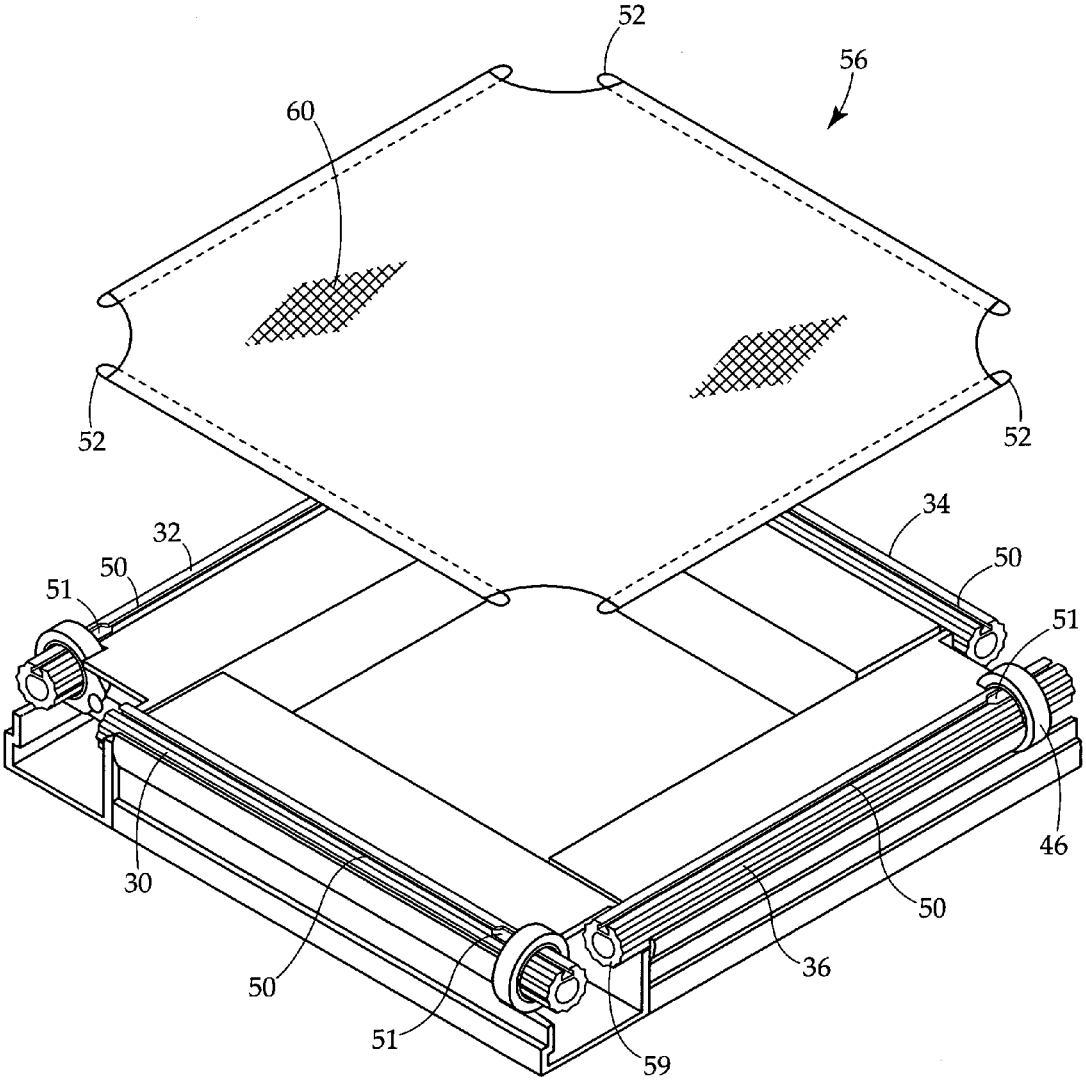
FIG. 7 is an exploded perspective view of the print screen frame and fabric panel.

The insertion of the fabric panel and the locking strip can best be understood and explained with reference to FIG. 1 and FIG. 7, which is an exploded view of the fabric panel 56, and locking strips 52. A locking strip and associated edge of fabric panel 56 would first be inserted into the groove or slot 50 of tension roller 32. Lateral locking strips 52 and their associated fabric panel edges would then be inserted into tension rollers 30 and 34. Tension roller 36 and its associated ratchet member 46 would be slidably partially disengaged from the frame within the trough 26 so that the fourth locking strip and fourth edge of the fabric panel 56 can be inserted into the groove or slot 50 on tension roller 36 using the flattened or planar area 51 at the entryway of groove or slot member 50 or directly into the groove or slot 50 at terminal end 59 of the tension roller. Once the locking strip has been inserted, tension roller 36 and its associated ratchet 46 are slidably reengaged with the frame and would be inserted at the end of the trough, and as the tension roller 36 was being slid in trough 26, the final locking strip and edge of the fabric panel 56 would be slid throughout the length of the groove or slot member 50.

With this design of the screen printing frame and the fabric panel, the screen printing frame can become an integral part of the printing apparatus which requires only the stenciled fabric panel to be separate and removable for storage. This concept eliminates the requirement that the user lift out the screen printing frame every time there was going to be a change out and insert a new one because the old one must remain associated with the fabric panel mounted thereon. This would allow the user to assign one color per screen printing frame for each station on the printing apparatus leading to a more inexpensive and quicker print process.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. An improved detachable screen fabric assembly for a printing screen system, said printing screen system, having a substantially rectangular frame, having a plurality of rails fixedly connected to one another; a plurality of tension rollers rotatably mounted to the plurality of rails and rotatable along a longitudinal axis, the ends of said tension rollers accepting a tensioning tool; the improvement comprising:

a longitudinal groove formed on each of said plurality of tension rollers, said longitudinal groove for receiving an edge of a detachable screen fabric therein, said detachable screen fabric having a substantially rectangular screen fabric surface having a flexible locking strip positioned on each edge thereof for insertion into said groove with said edge of said screen fabric, wherein said groove is longitudinally formed on each of said tension rollers, said groove having an entryway opening, wherein said groove is less than the length of said roller, each of said plurality of tension rollers being formed with at least one planar flat spot on its circumference in alignment with said groove for slidable insertion or removal of said lock strip and said respective edge of said detachable screen fabric from said tension roller, said groove further having a longitudinal upper slit for slidable receipt of said edge of said reinforced screen fabric.

2. The detachable screen fabric assembly described in claim 1, further comprising means to maintain tension on said screen fabric secured in said grooves of said tension rollers.

3. The detachable screen fabric assembly described in claim 2, wherein the means to maintain tension comprises a ratchet connected to one of the plurality of said tension rollers engagable with longitudinal serrations formed on said tension rollers.

4. The detachable screen fabric assembly described in claim 1 further comprising a lock strip configured to slidably insert into said groove entryway simultaneously with said edge of said screen fabric, said lock strip having a width dimension to be captured in said groove together with said edge of said detachable screen fabric.

5. The detachable screen fabric assembly described in claim 1, wherein said detachable screen fabric is formed with an arcuate cutout at the intersection of each edge thereof.

6. The detachable screen fabric assembly described in claim 5, wherein the flexible locking strips are mounted to said detachable screen fabric by insertion into a sleeve channel, said sleeve channel extending along each of said edges of said detachable screen fabric.

7. The detachable screen fabric assembly for a printing screen system in accordance with claim 1 wherein said groove and said upper slit extend the length of each said tension roller.

* * * * *